United States Patent [19]

Horton et al.

[11] Patent Number: 4,510,121

[45] Date of Patent: Apr. 9, 1985

[54] POWER RECOVERY SYSTEM FOR COAL LIQUEFACTION PROCESS

[75] Inventors: Joel R. Horton, Maryville; David M. Eissenberg, Oak Ridge, both of Tenn.

[73] Assignee: The United States of America as represented by the United States Department of Energy, Washington, D.C.

[21] Appl. No.: 442,331

[22] Filed: Nov. 17, 1982

[51] Int. Cl.[3] ..... B01D 19/00

[52] U.S. Cl. ..... 422/232; 55/190; 210/188; 422/242

[58] Field of Search ..... 55/183, 184, 190, 185, 55/192, 194, 201; 422/232, 242; 210/188

[56] References Cited

U.S. PATENT DOCUMENTS 3,212,232 10/1965 McMinn ..... 55/184

4,347,223 8/1982 Kitaoka et al. ..... 422/242

OTHER PUBLICATIONS

Horton, "Modification of Feed/Effluent Flow Work Exchangers for Slurry Service and Power Recovery in Coal Liquefaction Processes", 11/19/81.

*Primary Examiner*—Jay H. Woo

*Assistant Examiner*—J. L. Woodard

*Attorney, Agent, or Firm*—Earl L. Larcher; Stephen D. Hamel; Judson R. Hightower

[57] ABSTRACT

A flow work exchanger for use in feeding a reactant material to a high-pressure reactor vessel comprises an outer shell, an inner shell concentrically disposed within said outer shell, means for conducting said reactant into the lower end of said lower shell and then to said reactor vessel, and means for conducting a hotter product effluent from said reactor vessel into the upper end of said inner shell and out of the annulus between said inner and outer shells.

3 Claims, 8 Drawing Figures

POWER RECOVERY SYSTEM FOR COAL LIQUEFACTION PROCESS

BACKGROUND OF THE INVENTION

This invention, which was made under a contract with the United States Department of Energy, relates in general to a system for increasing the energy efficiency of a process such as coal liquefaction.

More particularly, the invention relates to a process system for using energy contained in effluent from a coal liquefaction reactor to perform most of the work necessary for injecting a reactant feed slurry into the reactor.

In coal liquefaction processes in which a slurry consisting of coal particles and liquid hydrocarbon compounds is reacted with hydrogen in a reaction vessel at a very high pressure, injection of the slurry into the reaction vessel has heretofore required the use of high-pressure differential pumps that use a large amount of energy. The combination of high pressure and the abrasive nature of the reactant slurry also causes rapid deterioration of charging pumps, which are costly and inconvenient to replace.

SUMMARY OF THE INVENTION

It is an object of this invention to provide a fluid-flow system wherein a fluid effluent containing vaporizable constituents supplies a portion of the energy required for injecting a reactant into a high-pressure reaction vessel.

Another object of the invention is to minimize the use of rapidly wearing, high-pressure differential pumps for injecting an abrasive slurry of coal and oil into a coal liquefaction vessel.

An additional object of the invention is to improve the efficiency of a coal liquefaction process by using a parallel arrangement of chambers in which gas is separated from hydrogenation products of the process as a means for pressurizing a coal/oil slurry injected into the liquefaction vessel.

Another object of the invention is to provide an improved chamber which utilizes effluent from a coal liquefaction reactor to inject a coal/oil slurry into the liquefaction reactor, the design of the chamber minimizing thermal stresses applied to its walls by contact of relatively high temperature reactor effluent and relatively low-temperature slurry therewith.

These objects and other advantages are achieved by a preferred embodiment of the invention comprising: a source of low temperature feed material consisting of coal particles, oil and hydrogen; a heater and reactor vessel wherein said feed material is heated then treated under high pressure and at high temperature to produce a reactor product effluent; a flow work exchanger comprising (1) an outer shell formed with a tubular, vertically extending side wall, an upper end cover, and a lower end cover, and (2) a tubular, vertically extending inner shell located within said outer shell and spaced from the side wall thereof to provide an annulus therebetween, the lower end of said inner shell being attached to the lower end cover of said outer shell and the upper end of said inner shell extending to a point adjacent but spaced from the upper end cover of said outer shell; first conduit means for conducting feed material from said source thereof into the lower portion of said inner shell of said flow work exchanger; second conduit means for conducting reactor product effluent from said reactor vessel into the upper portion of said outer shell of said flow work exchanger; third conduit means for conducting feed material from the lower portion of said inner shell of said flow work exchanger to said reactor vessel; fourth conduit means for releasing gas from the upper portion of said outer shell of said flow work exchanger; and fifth conduit means for releasing reactor product effluent from the lower portion of the annulus between said inner and outer shells of said flow work exchanger.

DETAILED DESCRIPTION OF THE PREFERRED EMBODIMENT OF THE INVENTION

Figure 1:
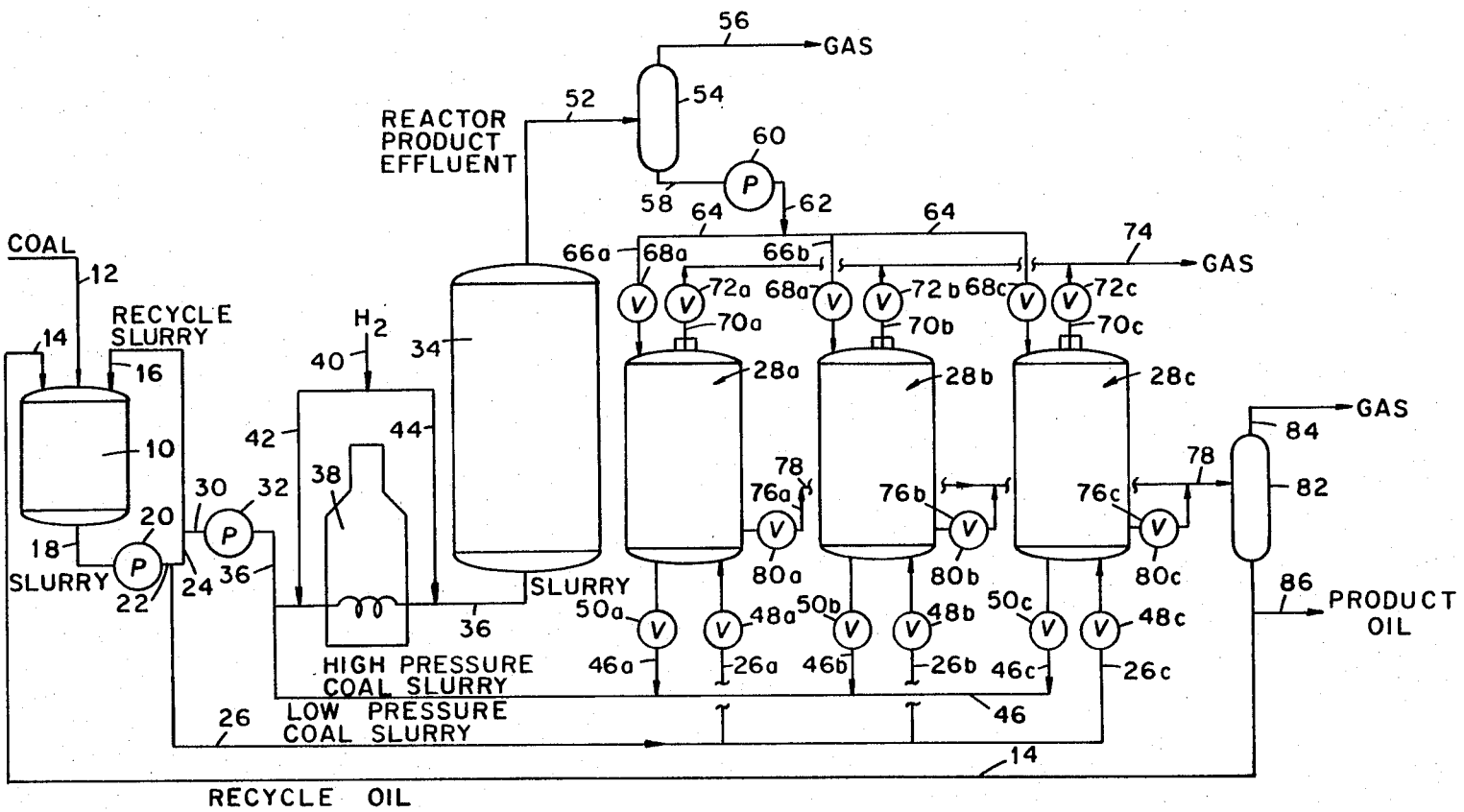
FIG. 1 is a schematic representation of a preferred apparatus embodiment of the invention.

In FIG. 1, reference number 10 designates a slurry mixing tank having three inlet conduits 12, 14, 16 and an outlet conduit 18 connected therewith. Outlet conduit 18 connects with the inlet of a pump 20, and a conduit 22 connected to the outlet of this pump branches into two conduits 24, 26. Conduit 26 connects with the lower ends of flow work exchangers 28*a*, 28*b*, 28*c* through riser conduits 26*a*, 26*b*, 26*c*, whereas conduit 24 branches into the aforesaid inlet conduit 16 and a conduit 30 connected to the inlet of a pump 32. The outlet of the last-mentioned pump connects with the lower portion of a reactor vessel 34 through a conduit 36 that passes through a heater 38. A hydrogen feed conduit 40 branches into two conduits 42, 44 that respectively connect with conduit 36 on opposite sides of heater 38. A conduit 46 extends between conduit 36 and riser conduits 46*a*, 46*b*, 46*c* connected to the lower ends of flow work exchangers 28*a*, 28*b*, 28*c*. Valves 48*a*, 48*b*, 48*c* and valves 50*a*, 50*b*, 50*c* are respectively installed in riser conduits 26*a*, 26*b*, 26*c* and riser conduits 46*a*, 46*b*, 46*c* to control fluid flow therethrough, as will be described in detail hereinafter.

An effluent conduit 52 extends from the top of the reactor vessel 34 to the middle portion of a gas/liquid separator 54, and a gas outlet conduit 56 is connected to the upper end of this separator and an effluent conduit 58 is connected to its lower end and to the inlet of a low-pressure differential pump 60. A conduit 62 extends from the outlet of pump 60 to a horizontal main 62, and riser conduits 66*a*, 66*b*, 66*c* respectively connect with the main and with the upper ends of flow work exchangers 28*a*, 28*b*, 28*c* and have valves 68*a*, 68*b*, 68*c* installed therein to control fluid flow therethrough in a sequence which will also be explained hereinafter. Gas vent conduits 70*a*, 70*b*, 70*c* provided with flow control valves 72*a*, 72*b*, 72*c* respectively connect with the upper ends of flow work exchangers 28*a*, 28*b*, 28*c* and with a horizontal main 74. Effluent discharge conduits 76*a*, 76*b*, 76*c* are respectively connected to the lower portions of the flow work exchangers and to a main 78, these conduits also being provided with valves 80*a*, 80*b*, 80*c* to control fluid flow therethrough. Main 78 connects with the middle portion of a second gas/liquid separator 82 provided at its upper end with a gas vent conduit 84 and connected at its lower end to an oil outlet conduit 86 which branches into the previously mentioned recycle oil conduit 14 and a product oil conduit 88.

Figure 2:
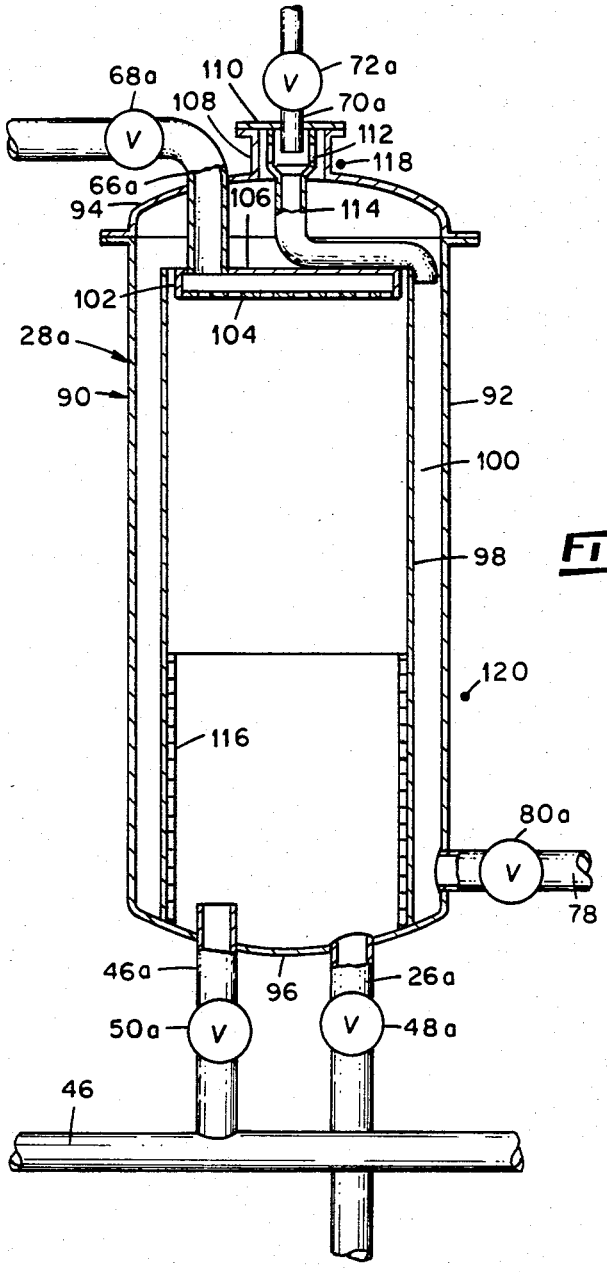
FIG. 2 is a cross-sectional detail view of a typical one of three flow work exchangers used in the apparatus illustrated in FIG. 1.

The construction of flow work exchanger 28*a* illustrated in cross section in FIG. 2 is the same as that of the other two flow work exchangers 28*b*, 28*c* and comprises an outer shell which is generally designated by reference number 90 and which is formed with a tubular, vertically extending side wall 92, an upper end cover 94, and a lower end cover 96. Located within outer shell 90 is a tubular, vertically extending inner shell 98 attached at its lower end to end cover 96 and concentrically spaced from the side wall of the outer shell to provide an annulus 100 therebetween. The upper end of inner shell 98 extends to a point adjacent but spaced from upper end cover 94 as illustrated. A circular distributor pan, generally designated by reference number 102 and provided with a perforated lower end wall 104, is positioned in the upper end of inner shell 98 and concentrically spaced from the wall of the inner shell to provide an annulus therebetween as illustrated, and the riser conduit associated with each flow work exchanger 28*a*, 28*b*, 28*c* (riser conduit 66*a* in the case of the illustrated flow work exchanger 28*a*) extends in sealed relation through an aperture in the upper end cover 94 of the flow work exchanger and connects to the upper end wall 106 around the edge of an inlet aperture formed in the latter. An aperture is formed at the center of upper end cover 94, and a short cylindrical tube 108 is welded to the end cover around the edge of this aperture and projects upwardly therefrom. An end plate 110 is attached to the upper end of tube 108, the end plate having at its center an aperture through which a respective one of the outlet risers 70*a*, 70*b*, 70*c* extends. A gas/liquid separator columns 112 is attached to the inner side of end plate 110 in concentric, spaced relation with the downwardly projecting end of the respective outlet riser and the wall of tube 108. A tangential inlet extends through the wall of a cyclone-type separator column 112, and a liquid return pipe 114 is connected to the lower end of the separator column and is bent so as to extend into the upper portion of the annular 100 between the inner and outer shells 90, 98. It should be noted that each riser 46*a*, 46*b*, 46*c* projects a short distance above its associated lower end cover 96, for a purpose that will be shown hereinafter. A lining 116 of a suitable thermal insulation, such as refractory bricks, may be provided within the lower end portion of inner shell 98. A gas/liquid density detector 118 is positioned adjacent the wall of tube 108, and a detector 120 for detecting the level of liquid in annulus 100 is positioned adjacent the wall of outer shell 92 slightly below the midpoint thereof.

DESCRIPTION OF OPERATION OF THE PREFERRED EMBODIMENT OF THE INVENTION

The operation of flow work exchangers 28*a*, 28*b*, 28*c* is basically the same as that of containment vessels 34*a*, 34*b*, 34*c* described in assignee's U.S. patent application Ser. No. 257,032, filed on Apr. 24, 1981 by Joel R. Horton, the disclosure of which is intended to be incorporated herewith by this reference thereto. However, as will become manifest in the following description of the sequence of operational flow of fluids into and out of flow work exchangers 28*a*, 28*b*, 28*c*, the fluid-flow system of this invention minimizes thermal stresses being imposed upon the walls of the flow work exchangers by movement of both relatively high-temperature product effluent from reactor vessel 34 and relatively low-temperature fresh slurry from slurry mixing tank 10 into and out of the exchangers. In contrast, containment vessels 34*a*, 34*b*, 34*c* of the apparatus described in the previously filed application are subjected to greater thermal stresses by streams of the same product effluent and slurry.

Figure 3:
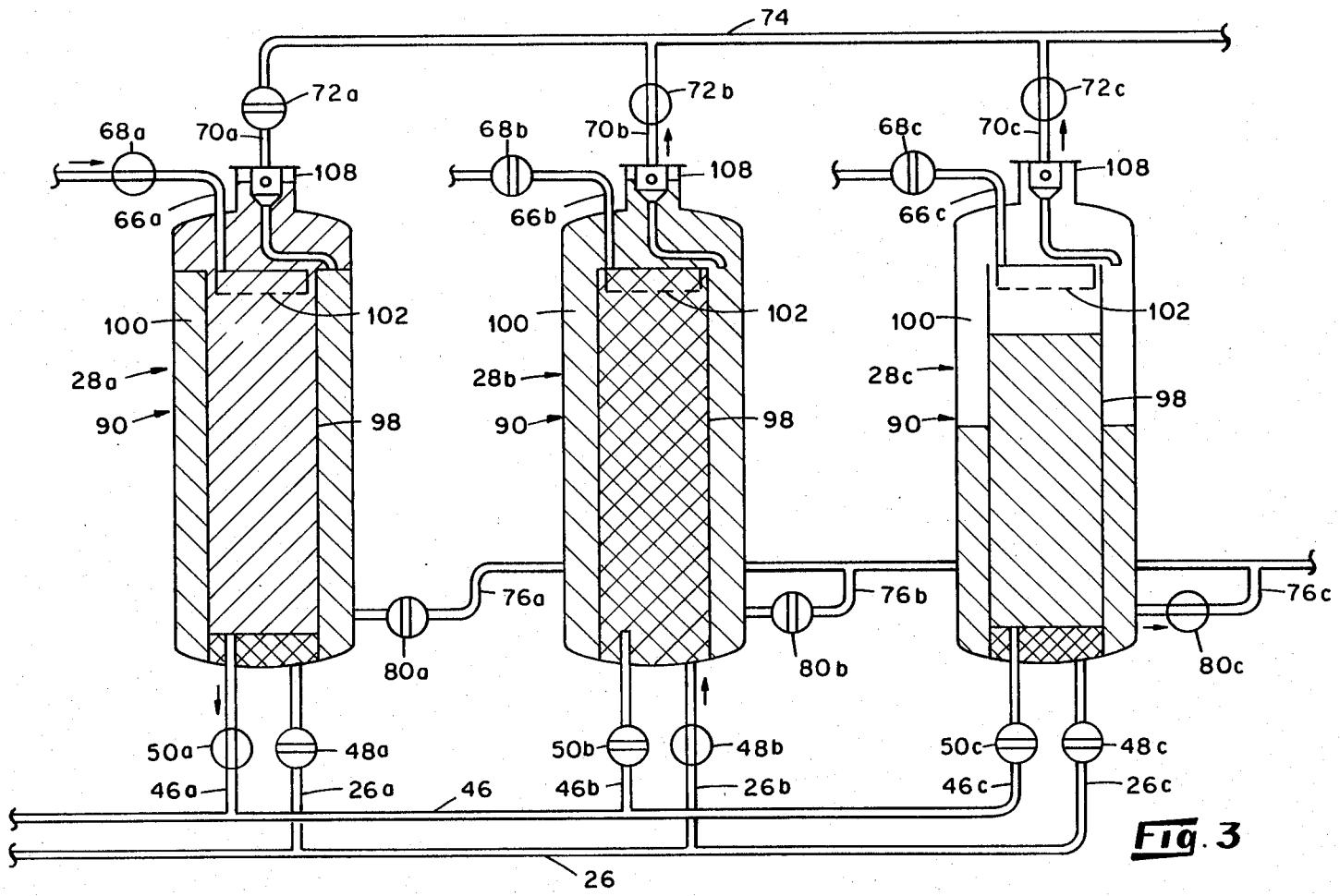
FIGS. 3–8 illustrate the different operational settings of valves which control the flow of materials into and out of the three flow work exchangers included in the apparatus of FIG. 1.

The operational cycle of flow work exchangers 28*a*, 28*b*, 28*c* (hereinafter referred to as exchangers for brevity) is illustrated in FIGS. 3–8, with the conditions shown in FIG. 3 being arbitrarily selected as a starting point for the purpose of description. In FIG. 3, the settings of valves in the flow conduits connected to exchanger 28*a* and the levels of different fluids in this exchanger are represented at the end of a period during which valve 68*a* and valve 50*a* are open and valves 48*a*, 72*a* and 80*a* are closed. Hence, product effluent from reactor vessel 34 flows through conduit 52, gas/liquid separator 54 (wherein some of the gas in the product effluent is separated therefrom), conduit 58, pump 60, conduit 62 and riser 66*a* into the distributor pan 102 in the upper portion of inner shell 98 of exchanger 28*a* and thence into the inner shell itself. Product effluent which has entered exchanger 28*a* from reactor vessel 34 is represented by cross-hatch lines sloping upward to the right in the drawing. The quantity of reactor product effluent in the exchanger 28*a* when the valves associated with the exchanger are arranged as illustrated in FIG. 3 is such that product effluent fills inner shell 98 above the upper end of conduit 46*a* and also occupies the portion of outer shell 90 above the upper end of the inner shell, the level of the reactor product effluent reaching into tube 108 as illustrated. This body of reactor product effluent contains gas, since only a portion of the gas which is dissolved in the product effluent when it passes out of reactor vessel is separated from effluent in gas/liquid separator 54 as previously mentioned. It must also be noted that reactor product effluent entering each exchanger 28*a*, 28*b*, 28*c* is at a high temperature and pressure. In FIG. 3, the annulus between inner shell 98 and outer shell 90 of exchanger 28*a* is filled with reactor product effluent from which most of the initially dissolved gas in the effluent has been removed during subsequent stages in the operation of the exchanger, this effluent which contains only a small amount of dissolved gas being represented in the drawing by cross-hatch lines sloping downward to the right therein and being referred to hereinafter as degassed reactor effluent (or simply as degassed effluent). In FIG. 3, a heel of fresh slurry (which has entered exchanger 28*a* from tank 10 and which consists of particulate coal in oil) remains in the lower portion of inner shell 98 of exchanger 28*a* below the upper end of riser 46*a* when the exchanger has been filled with effluent from reactor 34 as illustrated, the slurry being represented by cross-hatch lines which slope in opposite directions and cross one another. As will be shown hereinafter, before the fluids in exchanger 28*a* reach the levels illustrated in FIG. 3, reactor effluent which enters inner shell 98 under high pressure (essentially the pressure head in reactor vessel 34 plus the pressure head of pump 60) forces slurry downwardly in the inner shell and through riser 46*a*, open valve 50*a*, conduits 26, 24, 30, pump 32, and conduit 36 into the lower end of the reactor vessel. When fluids in exchanger reach the levels indicated in FIG. 3, valves associated with the exchanger are adjusted to the settings illustrated in FIG. 4, producing new fluid flow conditions which will presently be described.

While effluent from reactor vessel 34 has been entering exchanger 28*a* as just described, the valves in the flow conduits connected to exchanger 28*b* are in the positions shown in FIG. 3 and fresh slurry from tank 10 has been entering the lower end of inner shell 98 of that exchanger through riser 26*b* and open valve 48*b*, the level of fresh slurry rising to a point below the upper end of the inner shell when the settings of said valves are changed to the positions illustrated in FIG. 4 (the changes of the settings of valves associated with exchangers 28*a* and 28*b* occurring simultaneously). While slurry is being pumped into exchanger 28*b*, valve 72*b* is open so that gas in the upper portion can be pushed out through riser 70*b*. As will be shown hereinafter, while the level of fresh slurry in inner shell 98 of exchanger 28*b* is rising, degassed reactor effluent is pushed upward in the inner shell and flows over its upper edge into annulus 100, the level of degassed effluent eventually rising to a point in tube 108 as illustrated.

While slurry is being discharged from exchanger 28*a* and is entering exchanger 28*b* as described, the valves in the flow conduits connected to exchanger 28*c* are in the positions shown in FIG. 3, and degassed reactor effluent in annulus 100 of that exchanger has been flowing out of the exchanger through open valve 80*c*, riser 76*c*, and main 78 to gas/liquid separator 82 where more of the small amount of gas remaining in this degassed effluent is removed, the effluent from the separator being divided into the product oil which flows through conduit 88 and the recycle oil which flows through conduit 14 to mixing tank 10. Valve 72*c* is open to permit gas evolved from the reactor effluent in exchanger 28*c* to vent through riser 70*c*. Note that a heel of degassing slurry remains in the inner shell 98 of exchanger 28*c* while degassed reactor effluent is flowing from the exchanger. Valves associated with exchanger 28*c* change to the positions illustrated in FIG. 4 when the level of degassed reactor effluent reaches the level illustrated in FIG. 3, simultaneously with the change of the settings of valves associated with exchangers 28*a* and 28*b*.

After exchanger 28*a* has been charged with reactor effluent to the level illustrated in FIG. 3, valves 50*a* and 68*a* are closed, valve 80*a* is opened, and valves 48*a* and 72*a* are left in closed position, whereupon the high pressure in the exchanger forces degassed reactor effluent in annulus 100 through riser 76*a* and main 78 to gas/liquid separator 82. As effluent flows from exchanger 23*a*, pressure in the exchanger drops and gas consequently boils out of the charge of reactor effluent in the exchanger (this boiling of gas from reactor effluent being represented in FIG. 4 by small circles with arrows projecting upward therefrom). The level of reactor effluent in exchanger 23*a* drops from the position illustrated in FIG. 3 as degassed effluent flows from the exchanger.

Figure 4:
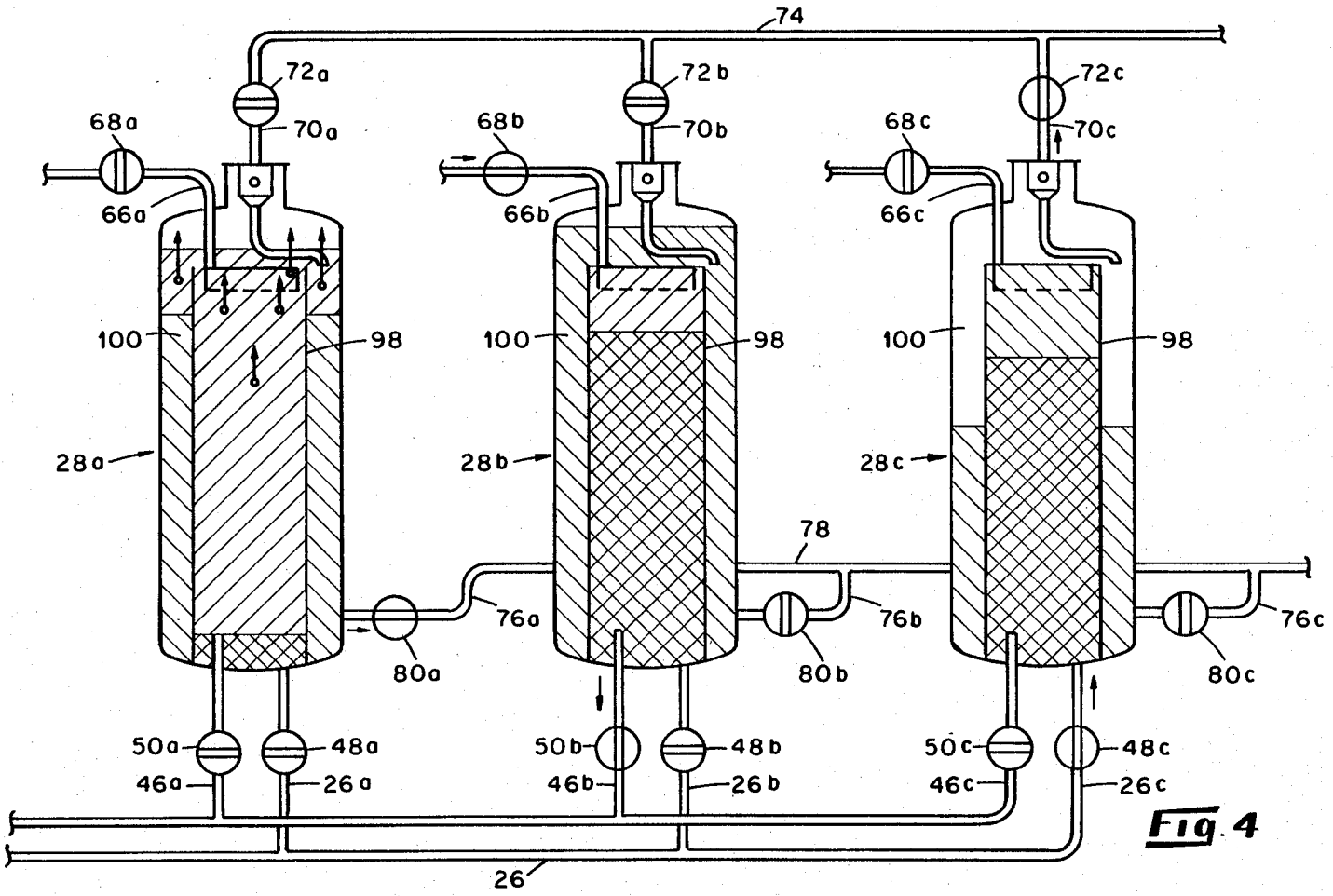

While degassed reactor effluent is flowing out of exchanger 28*a* as illustrated in FIG. 4, high-pressure reactor effluent is flowing into exchanger 28*b* and forcing slurry from the exchanger through riser 46*b* to reactor vessel 34. At the same time, slurry is entering the lower end of exchanger 28*c* and gas is venting from the upper end of that exchanger.

Before the level of degassed reactor effluent in annulus 100 of exchanger 28*a* drops to the level shown in FIG. 5, valve 72*a* has been opened and pressure in the exchanger has dropped below the pressure which resulted from the opening of valve 80*a*. Consequently practically all of the gas in the reactor effluent in the inner shell 98 of exchanger 28*a* is boiled out of the effluent as degassed effluent in annulus 100 of the exchanger is flowing through open valve 80*a*, riser 76*a*, and main 78 to separator 82. When degassed reactor effluent in annulus 100 of exchanger 28*a* reaches the level shown in FIG. 5, valve 80*a* is closed and valve 48*a* is opened as illustrated in FIG. 6, valve 72*a* being kept in open position and valves 50*a* and 68*a* being kept in closed position. Hence, slurry is permitted to flow into the lower portion of the inner shell 98 of exchanger 28*a*, and the rising slurry pushes degassed reactor effluent in the inner shell upwardly and over the upper edge of the inner shell into annulus 100, as indicated by arrows in FIG. 6 and then filling essentially the remainder of vessel 28*a* to the level of sensor 118. The fresh slurry level does not exceed the top of the annulus.

Figure 5:
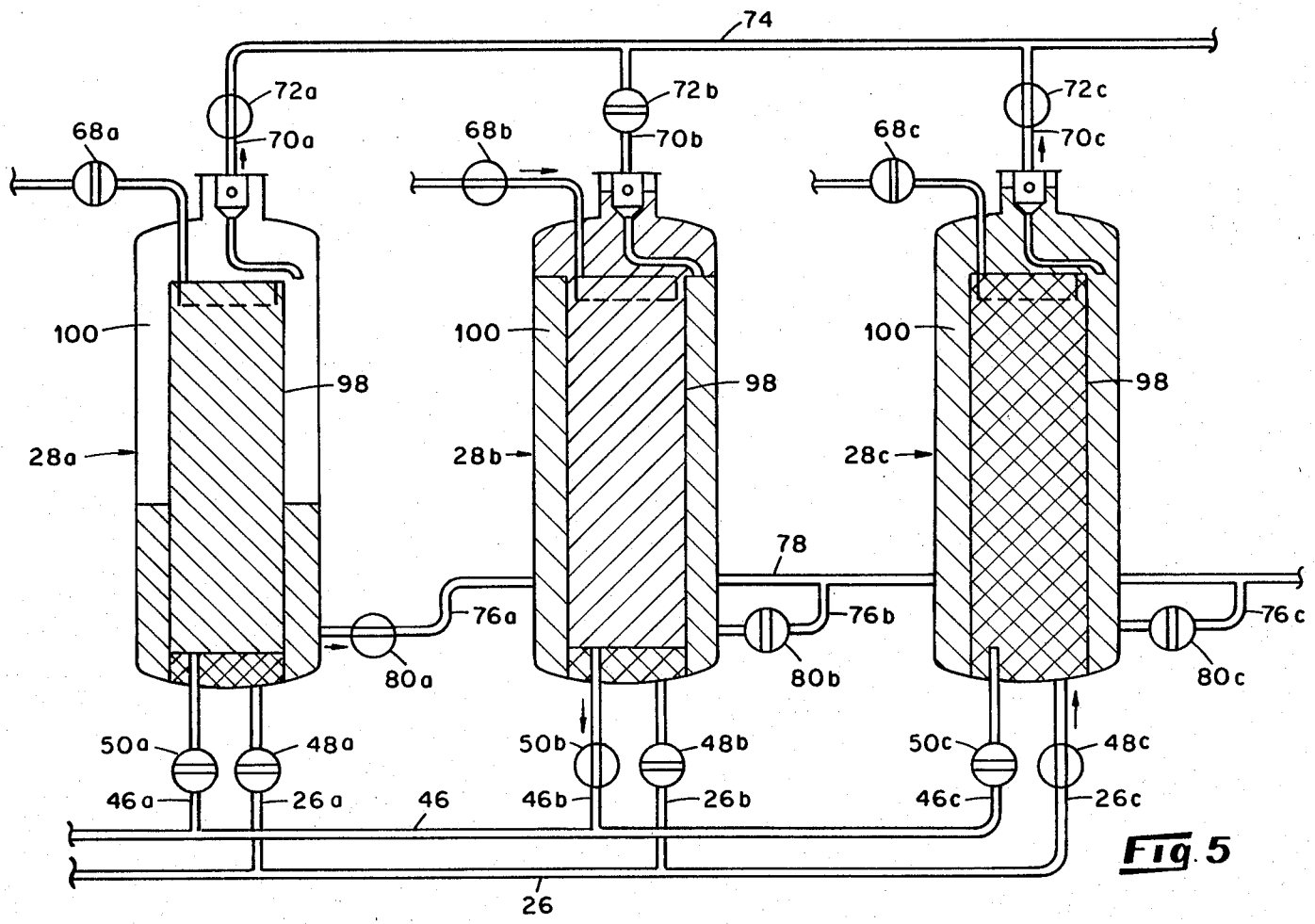
Figure 6:
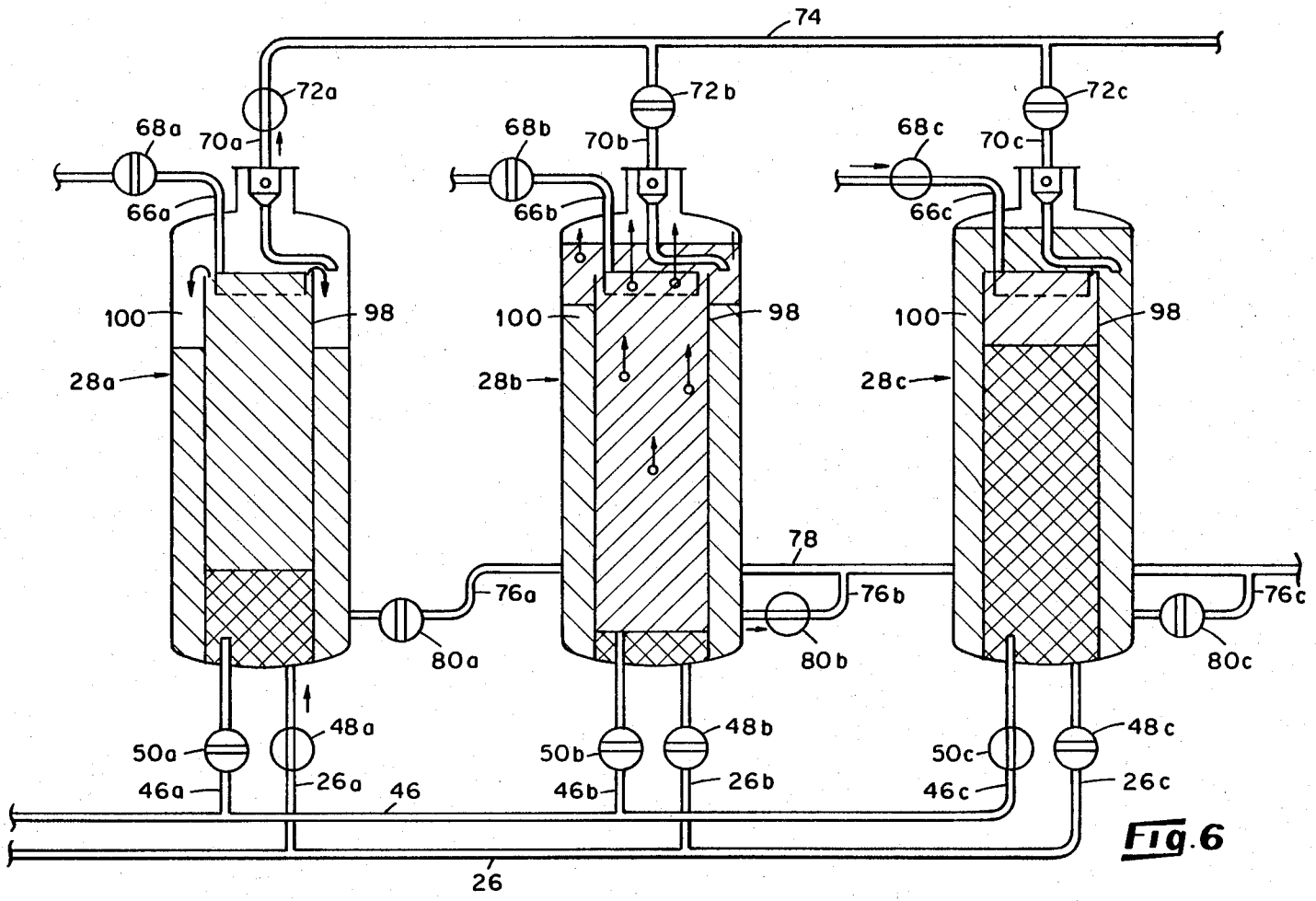
Figure 7:
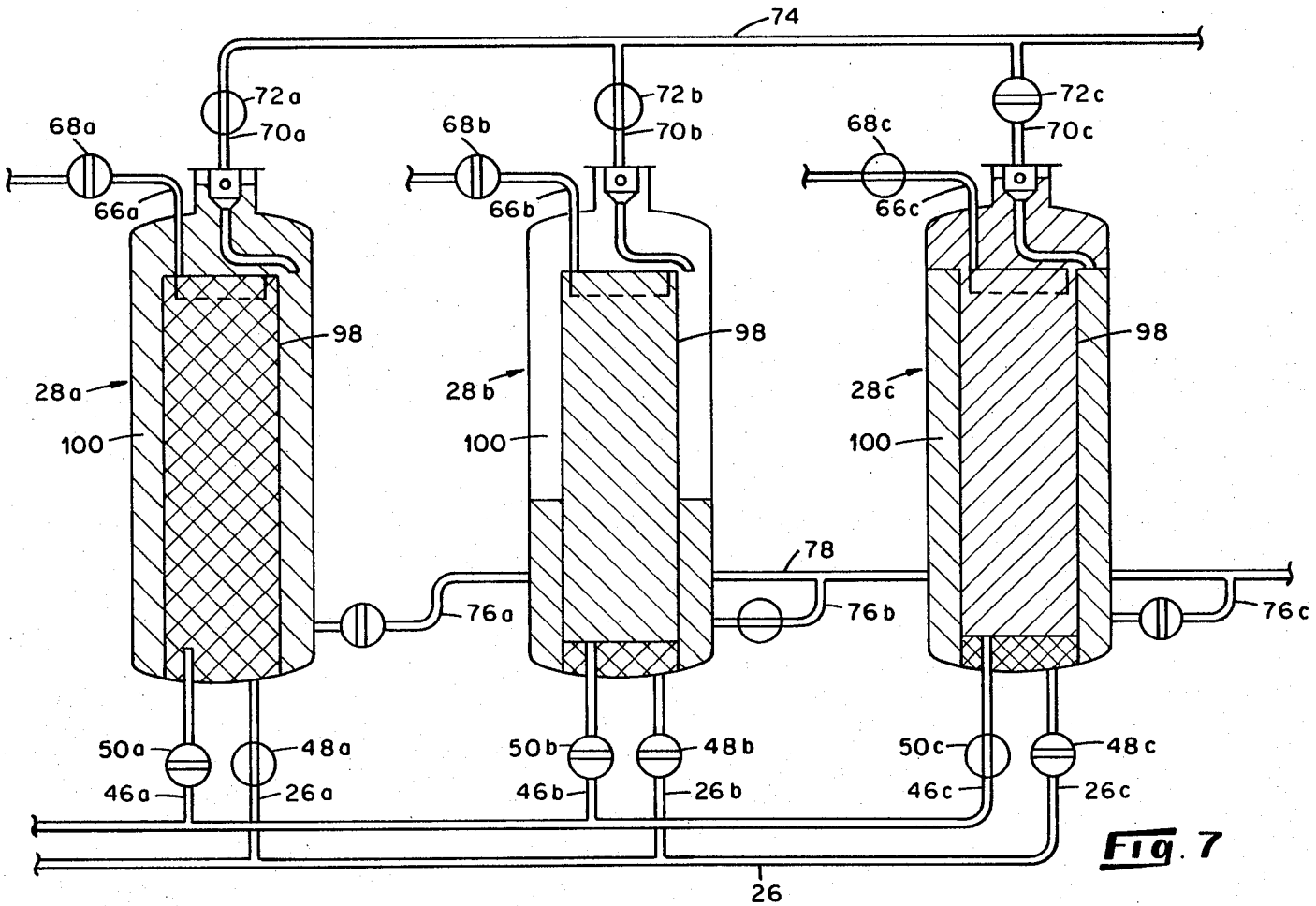
Figure 8:
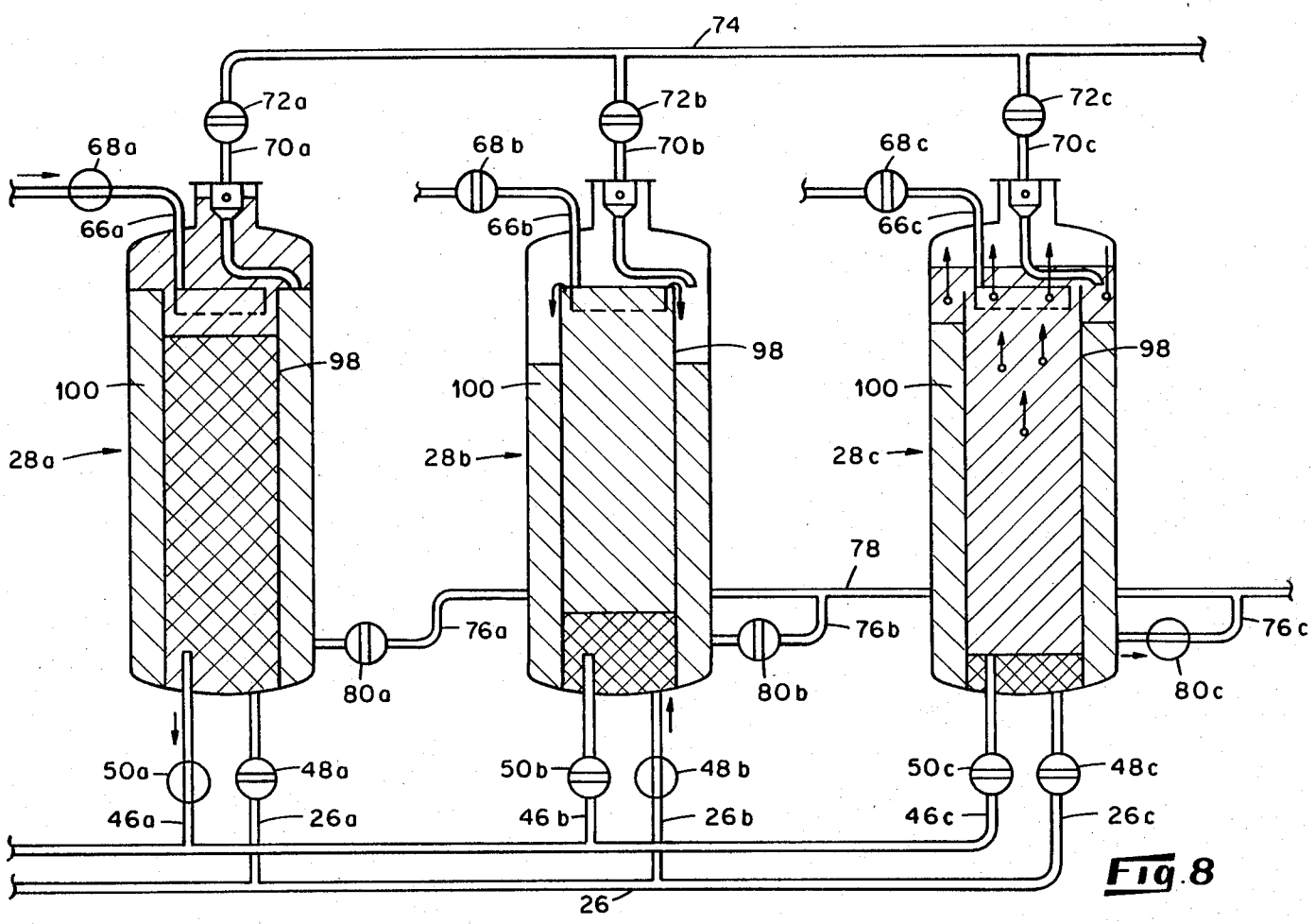

While degassed reactor effluent is flowing out of exchanger 28*a* as illustrated in FIGS. 4 and 5, reactor effluent from reactor vessel 34 is entering exchanger 28*b* and pushing slurry out of the latter as also illustrated in the same drawings. When valve 80*a* is changed from closed to open position and valve 48*a* is changed from closed to open position (which transitions are shown in FIGS. 5 and 6), valves 50*b* and 68*b* are simultaneously changed from open to closed position, and valve 80*b* is changed from closed to open position. It will thus be seen that the setting of valves associated with exchanger 28*b* are the same in FIG. 6 as the settings of valves associated with exchanger 28*a* in FIG. 4, and the operational conditions in these exchangers is the same in these drawings. Likewise, the settings of valves associated with exchanger 28*c* in FIG. 6 are the same as the settings of valves associated with exchanger 28*b* in FIG. 4. The flow conditions of exchangers 28*b*, 28*c* that are illustrated in FIG. 7 are the same as the flow conditions of exchangers 28*a*, 28*b* in FIG. 5, respectively, and the same relationship of the exchangers will be seen to exist for FIGS. 6 and 8. Therefore, it will be necessary to describe the changes in the valve settings that are shown in FIGS. 7 and 8 for exchanger 28*a* to complete the description of the operational cycle of the apparatus.

After valve 48*a* has been opened to admit slurry into exchanger 28*a*, as illustrated in FIG. 6, the level of the slurry in the inner shell 98 rises until the upper edge of the inner shell is reached, as illustrated in FIG. 7. Valves 48*a* and 72*a* are then closed and valves 50*a* and 68*a* are opened, as illustrated in FIG. 8, and reactor effluent from reactor vessel 34 flows into the upper end of the inner shell 98 of exchanger 28*a* and forces slurry out through riser 46*a* to the reactor vessel. Eventually the level of slurry in the inner shell 98 of the exchanger 28*a* reaches the upper end of riser 46*a* in the exchanger, as illustrated in FIG. 3, and the sequence of operation of the three exchangers which has been described is repeated.

The described opening and closing of the valves associated with exchangers 28*a*, 28*b*, 28*c* can be effected by conventional means, such as gas/liquid density detectors 118, 120 respectively positioned at levels shown in FIG. 2. The gas/liquid separator columns 112 in the exchangers serves to separate reactor effluent from gas vented through the conduits 70*a*, 70*b*, 70*c*, this effluent being directed into the annulus 100 of each exchanger. Some mixing of fresh reactor effluent from reactor vessel 34 with degassed reactor effluent in the exchangers 28*a*, 28*b*, 28*c* may occur, but this will not interfere with the operation of the system, since the reduction of pressure in the exchangers during their operation causes gas to boil out of effluent before it passes from the exchangers. As will be seen by inspection of the drawings, a heel of slurry remains in each exchanger throughout the operation of the disclosed system, thereby keeping the slurry which flows to reactor vessel 10 largely unadulterated with reactor effluent. However, if any reactor effluent mixes with slurry that is transferred from the exchangers to the reactor vessel, this recycle of reactor effluent to the reactor vessel will not affect the coal liquefaction reaction which occurs therein.

It should be noted that the arrangement of each flow work exchanger 28*a*, 28*b*, 28*c* is such that hot reactor effluent in annulus 100 between its inner shell 98 and outer shell 90 protects the outer wall 92 of the outer shell from the cooler feed slurry introduced into the inner shell.

The design of the subject lock chamber is such that three-phase mixtures are never present in the valves, i.e., flashing occurs in the flow work exchangers 28*a*, 28*b*, 28*c*. Only degassed slurry exits the liquid discharge valves 80*a*, 80*b*, 80*c*. The de-entrainment separator columns 112 in the flow work exchangers 28*a*, 28*b*, 28*c* efficiently separate product gas flashing from the mixture so that only gases pass through gas valves 72*a*, 72*b*, 72*c*. This arrangement will permit use of conventional valves since there will be no flashing occurring in the valves nor will there be a pressure drop across the valves.

What is claimed is:

1. An apparatus for supplying feed material to a reactor vessel for treating said feed material at a high pressure and temperature to produce a gas-containing reactor product effluent at a relatively high pressure, feed material supply means, a flow work exchanger comprising an outer shell defined by (1) a vertically oriented tubular sidewall, an upper end cover and a lower end cover, and (2) a vertically oriented tubular inner shell disposed within said outer shell and radially inwardly spaced from said sidewall to define a vertically oriented annulus between the inner and outer shells, the lower end of said inner shell being attached to said lower end cover and the upper end of said inner shell extending to a location adjacent to but spaced from said upper end cover, first conduit means coupled to said feed material supply means and said lower end cover for conveying feed material at a relatively low pressure into said inner shell, second conduit means coupled to the reactor vessel and said upper end cover for conveying said reactor product effluent from the reactor vessel into the upper portion of said inner shell for displacing feed material from said inner shell, third conduit means coupled to said lower end cover and said reactor vessel for conveying feed material displaced from said inner shell to the reactor vessel, fourth conduit means coupled to said upper end cover for conveying gas released from said reactor product effluent from the upper portion of said outer shell, and a fifth conduit means coupled to said outer shell for releasing reactor product effluent from said annulus.

2. The apparatus of claim 1 including:

a distributor pan positioned in the upper end of said inner shell and provided with a perforate lower end wall, said distributor pan being spaced from the wall of said inner shell to provide an annulus therebetween, said second conduit means being connected to said distributor pan so as to introduce said reactor product effluent therein.

3. The process system of claim 2 including:

a gas/liquid separator positioned in the upper portion of said flow work exchanger for separating reactor product effluent from the gas conveyed through said fourth conduit means.

* * * * *